US012546083B2

(12) United States Patent
Zock et al.

(10) Patent No.: US 12,546,083 B2
(45) Date of Patent: Feb. 10, 2026

(54) HEAVY DUTY SILT FENCE USING NONWOVEN SILT RETENTION FABRIC

(71) Applicant: MKB Company, LLC, Groveport, OH (US)

(72) Inventors: Michael A. Zock, Saxonburg, PA (US); Nick Dreher, Sarver, PA (US); Benjamin Swarey, Belleville, PA (US)

(73) Assignee: MAZCON, A KURTZ BROS. COMPANY, LLC, Groveport, OH (US)

( * ) Notice: Subject to any disclaimer, the term of this patent is extended or adjusted under 35 U.S.C. 154(b) by 1534 days.

(21) Appl. No.: 16/746,947

(22) Filed: Jan. 19, 2020

(65) Prior Publication Data

US 2020/0370251 A1 Nov. 26, 2020

Related U.S. Application Data

(60) Provisional application No. 62/851,126, filed on May 22, 2019.

(51) Int. Cl.
*E02D 17/20* (2006.01)
*D04H 1/46* (2012.01)
(Continued)

(52) U.S. Cl.
CPC ..... *E02D 17/20* (2013.01); *D04H 1/46* (2013.01); *D04H 3/005* (2013.01); *D04H 3/016* (2013.01);
(Continued)

(58) Field of Classification Search
CPC ..... E02D 17/20; D04H 1/46; D04H 3/005; D04H 3/016; D04H 3/102; E01F 7/02;
(Continued)

(56) References Cited

U.S. PATENT DOCUMENTS 4,073,143 A 2/1978 Preus
4,756,511 A 7/1988 Wright, III
(Continued)

FOREIGN PATENT DOCUMENTS

WO 2017218711 12/2017

OTHER PUBLICATIONS

Textile glossary definition of "staple fiber", p. 150 (Year: 2001).*

*Primary Examiner* — Elizabeth M Imani
(74) *Attorney, Agent, or Firm* — Blynn L. Shideler; Krisanne Shideler; .BLK Law Group

(57) ABSTRACT

A silt fence includes a plurality of spaced stakes and a silt fence fabric coupled to the stakes wherein the silt fence fabric is a nonwoven needle punched fabric having a thickness of at least 5.25 mm, a denier size of 10-25 and a weight of 9-24 oz/square yard. The silt fence fabric may be asymmetrical dual sided needle punched wherein the downstream side of the fabric is punched 2-6 times more than the upstream side. The silt fence fabric may have a transverse direction orientation of fibers forming the fabric. The fence may include two independent tensioning members. The silt fence may include at least one vertical transverstivity cutoff element that prevents water from migrating from above the cutoff element within the fabric to below the cutoff element.

5 Claims, 5 Drawing Sheets

(51) Int. Cl.

| | |
|---|---|
| ***D04H 3/005*** | (2012.01) |
| ***D04H 3/016*** | (2012.01) |
| ***D04H 3/10*** | (2012.01) |
| ***E01F 7/02*** | (2006.01) |

(52) U.S. Cl.
CPC ..... *D04H 3/102* (2013.01); *E01F 7/02* (2013.01); *D10B 2321/022* (2013.01); *D10B 2403/01* (2013.01); *D10B 2505/204* (2013.01)

(58) Field of Classification Search
CPC ..... D10B 2321/022; D10B 2403/01; D10B 2505/204
See application file for complete search history.

(56) References Cited

U.S. PATENT DOCUMENTS

| | | | | |
|---|---|---|---|---|
| 5,660,505 | A | 8/1997 | Emory, III | |
| 5,758,868 | A | 6/1998 | Shea | |
| 6,053,665 | A | 4/2000 | Richardson | |
| 6,945,739 | B1 * | 9/2005 | Putman | E02D 19/18 405/15 |
| 7,008,143 | B1 | 3/2006 | Wolfe | |
| 7,157,010 | B1 | 1/2007 | Wolfe | |
| 7,465,129 | B2 | 12/2008 | Singleton | |
| 7,870,965 | B2 * | 1/2011 | Cronia | B01J 20/28011 210/502.1 |
| RE42,695 | E | 9/2011 | Singleton | |
| 8,465,230 | B1 | 6/2013 | O'Reilly | |
| 8,747,027 | B1 | 6/2014 | Singleton | |
| 2006/0133900 | A1 * | 6/2006 | Singleton | E02D 17/20 405/302.7 |
| 2014/0154018 | A1 | 6/2014 | Singleton | |
| 2017/0204582 | A1 * | 7/2017 | Allard | E02D 17/205 |

* cited by examiner

FIG. 4A
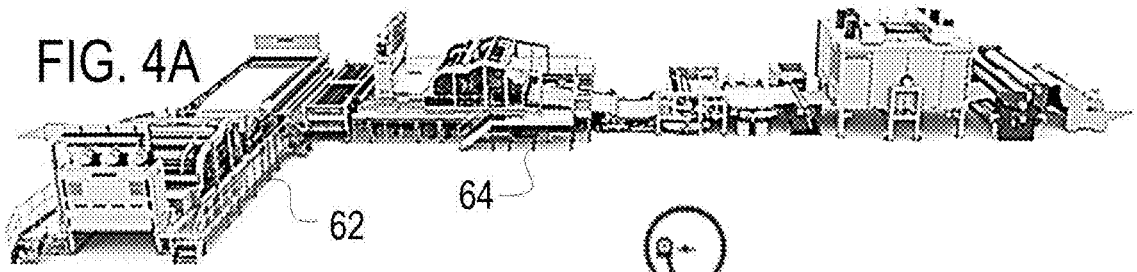
FIG. 4B
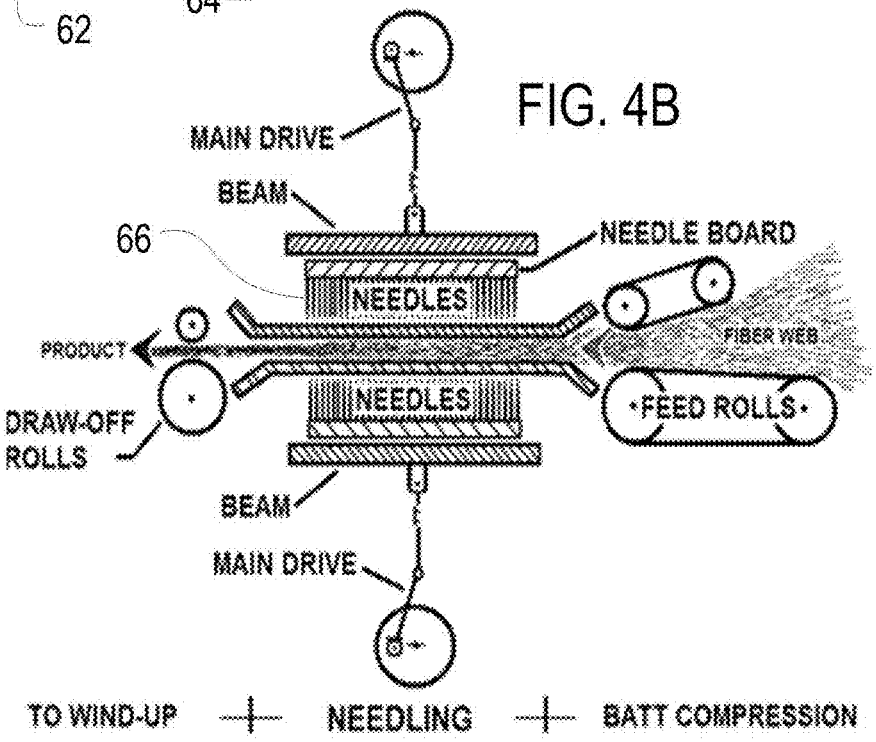
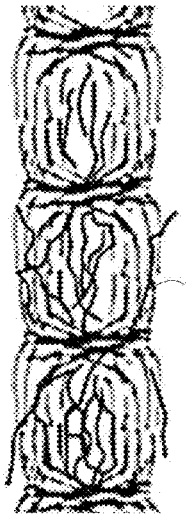
FIG. 5A
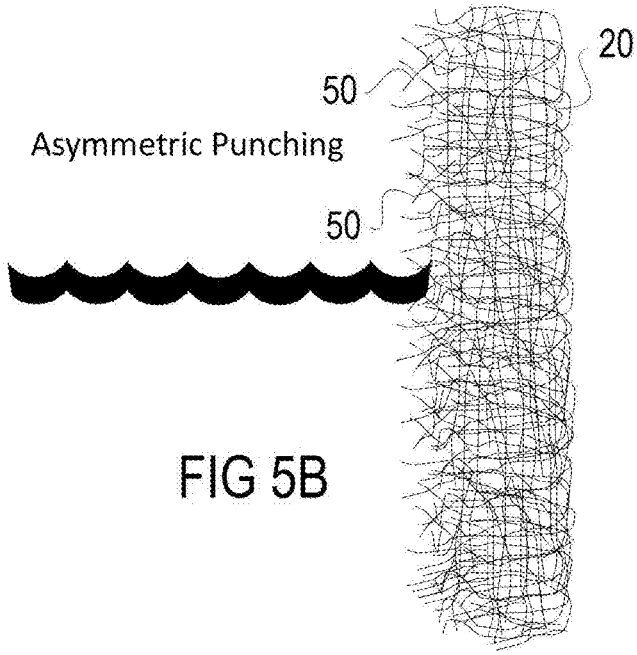
FIG 5B

HEAVY DUTY SILT FENCE USING NONWOVEN SILT RETENTION FABRIC

CROSS-REFERENCE TO RELATED APPLICATIONS

This application claims the benefit of U.S. Provisional Patent Application Ser. No. 62/851,126, entitled "Heavy Duty Silt Fence Using Nonwoven Silt Retention Fabric", filed on May 22, 2019, which is incorporated herein by reference.

BACKGROUND OF THE INVENTION

1. Field of the Invention

The present invention relates to silt fences, more specifically to a high strength silt fence.

2. Description of Related Art

A silt fence, sometimes called a "filter fence," is a temporary sediment control device used on construction sites to protect water quality in nearby streams, rivers, lakes and seas from sediment (loose soil) in storm-water runoff. Silt fences are widely used on construction sites in North America and elsewhere, due to their low cost and simple design.

Silt fences are often perimeter controls and a typical fence consists of a piece of synthetic filter fabric (also called a geotextile) stretched between a series of wooden or metal fence stakes along a horizontal contour level. The stakes are generally installed on the downhill side of the fence, except sometimes at overlapping silt fence sections, and the bottom edge of the fabric can be trenched into the soil.

Hanes Geo Components manufactures a representative sample of commercially available silt fence geotextiles, such as the TERRATEX® SF-50, TERRATEX® SF-90, TERRATEX® SF-D, and NTPEP brands which generally are woven geotextiles made up of woven polypropylene filaments that are considered non-biodegradable and resistant to most soil chemicals, acids, and alkali with a pH range of 3 to 12.

In general, each state Department of Environmental Protection or similar agency will define the particulars for the silt fence in that jurisdiction. For Example the Pennsylvania DEP issues such as in a regulation titled "Best Management Practices for Erosion and Sedimentation Control". These particulars include minimum requirements for the fabric (strength, lifespan, flowrate, materials, etc.), height requirements for the fences and stakes, material, size and spacing requirements for the stakes, etc.

In practice one common silt fence uses an inexpensive woven silt fence material that comprises a polymeric sheet of generally under 2 mm in thickness. This common or basic silt fence is generally utilized to control runoff from a small disturbed area when the runoff is in the form of sheet flow and the discharge is to a stable area. This common type is also often used to supplement another sediment and erosion control device. This common type is not a high strength and represents the minimal in silt fence operational characteristics, and generally represents the design upon which silt fences improvements is attempting to build. The exceptional low costs of this has and will likely maintain this fencing in the industry, however this type is ineffective and unusable when more than the barest minimal silt fence operational characteristics are required.

The patent literature discusses and describes the state of the art in proposed silt fence construction, including some proposals that have not and will not be commercially viable. See for example U.S. Pat. Nos. 4,756,511, 5,660,505, 5,758,868, 6,053,665, 6,945,739, 7,008,143, 8,465,230 and 8,747,027 which are incorporated herein by reference. U.S. Pat. No. 4,073,143 and WO 2017-218711 also provide background information on silt fence construction, and these teachings are incorporated herein by reference. Collectively these patents and publication also give an acceptable overview of existing silt fence technologies.

U.S. Pat. No. 7,157,010 proposes an interesting silt fence construction and discloses a polymeric flocculant infused silt fence assembly comprising two opposing and attached geotextile sheets, each adapted to filter entrained non-colloidal particles and together encasing a layer of polymeric flocculant material. The polymeric flocculant material preferably comprises anionic polyarylmide. As water flow is flowed through the first geo-fabric sheet any entrained non-colloidal particles above the mesh size are filtered. Then the polymeric flocculant material coagulates a portion of the colloidal particles and forms flocs in the flowing water and the second geo-fabric sheet filters remaining entrained non-colloidal particles, including the coagulated flocs. The concept of adding to the functional performance of the silt fence in this application is desirable, but this implementation will have blinding problems that undesirably interferes with the flow characteristics of the silt fence.

U.S. Publication 2014-0154018 and U.S. Pat. No. 7,465,129 (Now reissued as Re42,695, which is incorporated herein by reference) all disclose reinforced silt retention sheet and systems for silt retention wherein the reinforced silt retention sheet includes a non-woven fabric having a series of entangled polymer fibers with a reinforcing material secured within or to the fabric. The Nonwoven structure of the silt fence fabric of these references is also important, and these references teach a non-woven fabric having fibers generally smaller than 10 microns in average diameter, 1 to about 10 denier per fiber (grams per 9000 meters of fiber), forming a fabric that has a fabric thickness of from about 0.1 to about 5 millimeters (mm) in thickness and a fabric weight of generally may be from about 35 to about 275 grams per square meter (gsm) which is about 1 to 8.1 oz per square yard. Further the fabric exhibits maximum apparent opening size (AOS) of 0.595 mm (30 mesh) or less, as measured according to ASTM D-4751 and a flow rate there through as measured according to ASTM D-4491 generally from about 35 to about 160 gallons/minute/square foot (gal/min/sq. ft.). This type has been commercialized under the SILT SAVER Brand and has obtained commercial acceptance. The resultant reinforced silt retention sheet improves the strength and flow characteristics of the prior basic silt fences, which is helpful, but this design does not optimize silt fence construction in nonwoven fabrics.

There is a need for a simple efficient and effective high strength silt fence with improved silt fence fabrics and which provide for capturing pollutants from storm water.

SUMMARY OF THE INVENTION

A silt fence includes a plurality of spaced stakes and a silt fence fabric coupled to the stakes wherein the silt fence fabric is a nonwoven needle punched fabric having a thickness of at least 5.25 mm, a denier size of 10-25 and a weight of 9-24 oz/square yard. The silt fence fabric may be asymmetrical dual sided needle punched wherein the downstream side of the fabric is punched 2-6 times more than the upstream side. The silt fence fabric may have a transverse direction orientation of fibers forming the fabric. The fence may include two independent tensioning members. The silt fence may include at least one vertical transverstivity cutoff element that prevents water from migrating from above the cutoff element within the fabric to below the cutoff element.

These and other advantages of the present invention will be clarified in the detailed description of the preferred embodiments taken together with the associated figures.

BRIEF DESCRIPTION OF THE FIGURES

FIG. 4A schematically illustrates one fiber orientating processing line that may be used in forming the heavy duty silt fence of FIG. 1;

FIG. 4B schematically illustrates a dual sided needle punching processing arrangement that may be used in forming the nonwoven silt retention fabric of the heavy duty silt fence of FIG. 1; and FIGS. 5A and 5B schematically illustrate the dual side needle punch fabric that may be used in forming the nonwoven silt retention fabric of the heavy duty silt fence of FIG. 1.

DETAILED DESCRIPTION OF THE PREFERRED EMBODIMENTS

Figure 1A:
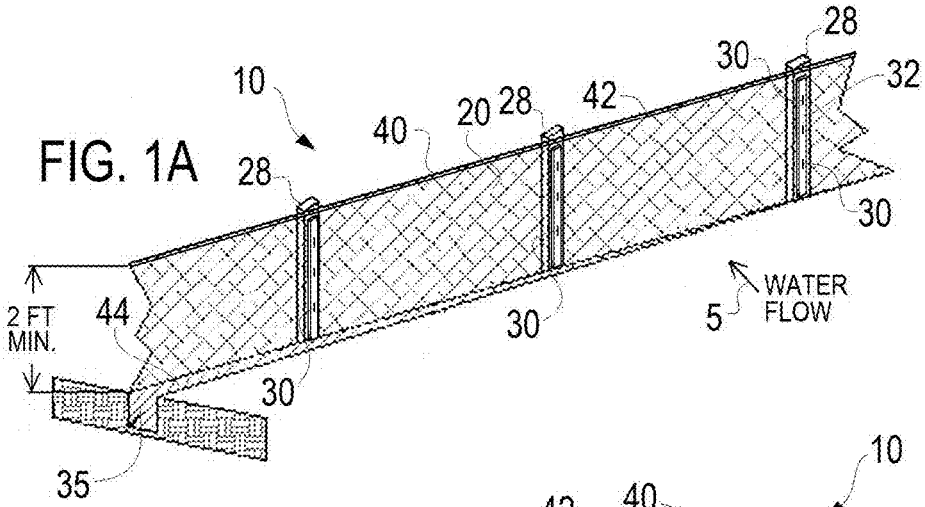
FIG. 1A schematically illustrates a perspective view of a heavy duty silt fence using nonwoven silt retention fabric according to one aspect of the present invention.

It is noted that, as used in this specification and the appended claims, the singular forms "a," "an," and "the" include plural referents unless expressly and unequivocally limited to one referent. The various embodiments and examples of the present invention as presented herein are each understood to be non-limiting with respect to the scope of the invention. The ASTM numbers represent the testing standards in place as of the filing date of this application.

One aspect of the present invention provides, in overview, a heavy duty silt fence 10 using nonwoven silt retention fabric 20 having a machine direction 22 extending the along the length of the fence 10 and a cross direction or transverse direction 24 extending generally in the "height" direction of the fence 10. The fabric 20 defines the hydraulic flow capacity for the silt fence 10. The fence 10 includes a plurality of stakes 28 secured to the silt fence fabric 20 at spaced locations, generally at 4' intervals, via staples 30 or similar fasteners through a lathe piece 32. The fence 10 is often placed in a trench 35 in installation.

The top of the fence 10 includes two independent tensioning members including belting 40 at the top of the fabric 20 and independent contained elastic belt 42. The ground level of the fence 10 includes a vertical transverstivity cutoff element (VTC element) 44. The belting 40, stakes 28 and cutoff element 44 define bounded reinforced box 27 with a central dynamic elongation area 25.

The fabric 20 is a geotextile which is specifically designed to be placed above ground (often in a vertical orientation but not always) to act as a dynamic filter-ponder in sediment retention applications. The fabric 20 could be used for silt fence, catch basic filtering inserts, de-watering bags, or other applications, although the fabric 20 is not intended as an absorbent or below ground stabilizing textile. The fabric 20 as compared to existing non-wovens in civil engineering market is focus primarily is on much higher hydraulic flow, with a secondary focus is strength, although massive strength from a textile perspective, is not needed in this application as a silt fence 10.

The fabric 10 achieves the right amount of strength in a different way from traditional civil or geotextile non-wovens which utilize small shorter fibers than in the fabric 20. The small and short fibers of prior art geotextiles pack denser than larger longer fibers of the present fabric 20 and makes such textiles strong, but way less hydraulic permittivity than the present invention. The fabric 20 of the fence 10 uses much larger and longer fibers 50 that pack less dense than typical prior art selections, but retain a lot of strength.

As will be discussed further below the fabric 20 in the embodiment can utilize fibers that are 4-inch long strand crimp/kinked 0.91 grams/cm3 polypropylene fibers 50. Further the fabric 20 preferably uses Dual Sided Asymmetric Punching yielding an increase of 5%-15% higher burst and puncture strength on the upstream or water side. The upstream side of the fabric 20 of fence 10 is also much courser and provides higher "blind-over" resistance.

As discussed below the fibers 50 of the fabric 20 are mostly oriented in the Transverse Direction (TD) 24, which can be considered the vertical orientation for the fence 10 and this orientation yields advantages with the 2'×4' "strong box" 27 design. The TD strength is perpendicular to top and bottom reinforcing elements, namely the belting 40 at the top of the fence 10 and stitching forming cutoff 44 at the bottom of the fence 10. The design includes Dynamic Elongation Area 25 in the middle belly of the 2'×4' strong box 27. Under dynamic stress, the textile will give a little within the area 25 and this dynamically changes the 3D filtering matrix to keep water seeping through.

Stakes 28

The stakes 28 of the silt fence 10 of the present invention are preferably formed of hardwood, or possibly metal (steel), and the fabric 20 is "stakeable" in that the fabric can be attached to these stakes 28 by conventional methods. Hardwood stakes of 1½"×1½" are preferred with heat kiln surface drying. Kiln surface drying is a processing of the stakes 28 in a kiln for 2-5 days (as opposed to a full 30 day drying cycle). The surface drying removes water from the surface of the stakes 28 and offers a lighter stake 28 without making the stake too brittle as would occur through conventional kiln drying through a full drying cycle. Additionally the surface drying minimizes the growth of mold and mildew on the stake 28 and retards rotting of the stake 28.

Preferably three to five staples 30 spaced from the ground line to the top of a 24" fence 10 height (above the ground) in a typical configuration. One staple 30 would typically be at or near the ground level. Further the use of a ¼" thick wooden lath or slat 32 helps properly set the depth of the staples 30 as well as better coupling the fabric 20 to the stake 28.

Rollable

The silt fence fabric 20 is rollable, meaning that the fabric 20 can be rolled for shipping and installation, both with and without the stakes 28 attached. As noted above the surface dried hardwood stakes 28 provide an advantage of mildew and mold resistance that is beneficial for storage. Fence lengths of 30'-65', and more commonly of 48', represent a convenient length for bundling, but any suitable length of silt fence 10 can be used.

Stake Spacing

The stakes 28 are spaced up to 10' apart in the silt fence of the invention, however they are preferably spaced 3-6' apart with 4' being preferred. The silt fence 10 is intended for heavy duty applications and 4' spacing adequately addresses this application and best defines the 2'×4' strong box 27 design for the fence 10.

Keyed Stake 28 Ends

The present invention provides for interconnecting the ends of segments of the silt fence 10 of the present invention. A segment of the silt fence 10 is one manufactured length or bundle of silt fence 10. Thus at any site the installed silt fence 10 can include a number of interconnected bundles of silt fence 10 segments. In order to promote interconnection of silt fence segments all of the stakes along a segment of silt fence 10 are on one side of the nonwoven silt retention fabric 20, except for the final stake 28 (or the initial stake 28) of the segment, which is placed on the opposite side of the fabric. This allows for a simple coupling/interconnecting of the next segment as follows. Before the final stake 28 of s given segment of silt fence 10 is installed (which has the stake 28 on the front of the fabric 20), the first stake 28 of the next segment of silt fence 10 is placed adjacent the last stake 28 along the line of the silt fence 10, then both adjacent stakes 28 of the two adjacent segments are pivoted 180 degrees, which will "key" or interconnect the two segments together and will align the stakes 28 and the two fence segments appropriately. If there are no other segments of fence 10 to attach then the last stake 28 can be rotated by itself to place it behind the fabric 20 and aligned with the other stakes 28. The keying works equally well if the initial stake 28 rather than the final stake 28 is on the opposite side of the fabric 20. The use of the initial stake 28 as the "offset stake" 28 means the initial stake 28 of the first segment of fence 10 is rotated without being keyed to an adjacent segment—rather than the final stake 28 of the final segment of fence 10.

Vertical Transverstivity Cutoff Element 44

The silt fence 10 includes at least one vertical transverstivity cutoff element (VTC element) 44 that prevents water from migrating from above the cutoff element 44 within the fabric 20 to below the cutoff element 44, preventing the transverse migration of water through the fabric 20 into the trench 35. The VTC element 44 makes most of the water travelling vertically through the textile or fabric 20 to exit the fabric 20 before going underground. Structurally the VTC element may be formed by a generally horizontal stitch line, or a double or triple line as needed, with tight enough stitches to prevent vertical migration of water within the fabric 20 across the VTC element 44. The VTC element 44 uses a double stitch line. The VTC element 44 is in a generally horizontal configuration when the silt fence 10 is installed. The VTC element 44 is to control flow through the fence 10 and one VTC element 44 is placed at ground level to prevent water from accumulating in the trench 35 in which the lower end of the fabric 20 of the fence 10 is placed. Additionally the VTC element 44 defines the lower boundary of the strong box 27. Other VTC elements could be added to further control vertical migration of water through the fabric 20 of the fence 10, if desired. The VTC element 44 (and others if present) can also be considered to add reinforcement to the fabric 20 at the locations provided.

Tensioning Members

As noted above the top of the fence 10 includes two independent tensioning members including belting 40 at the top of the fabric 20 and independent contained elastic belt 42.

The belting 40 is generally about 3" wide and folded over the top edge of the fabric 20 and secured thereto. The belting 40 is preferably non-elastic, such as what is known as non-elastic strapping which resists elongation). The belting 40 at the top of the fabric provides a mechanism for reinforcing the fabric 20 and maintaining the tension at the top of the fence 10. The fence 10 includes a second independent tensioning member in the form of an elastic cord 42 contained generally within the belting 40 except at the stakes 40 in which the cord 42 is outside the belting 40 and accessible to the user to be wrapped around the stake 28 to provide secondary tensioning as needed. In operation if the top of the fence 10 sags over use, then the user can grasp the cord 42 in the area of the stakes 28 and wrap it around the stake 28 to pick up the slack. The cord could be pulled and tied without wrapping around the stake 28, but wrapping around the stake 28 is deemed to be easier.

Reinforcement

The (VTC element) 44, the belt 40, and the stakes 28 can be considered as reinforcement members of the silt fence 20. The belt 40 adds bout 361 LBS of strength while the VTC element 44 adds 100 LBS of strength to the fence 10. The silt fence 10 may include further reinforcing elements such as extra belting, a reinforcing scrim layer, patches or a separate backing layer (such as scrim layer, metal wire mesh layer, or other element).

Fence 10 Height

The height of the fence 10 is measured along the stakes 20 and is generally in the vertical direction in most implementations of the fence 10. There are two "heights" of the fabric 20 of the fence 10, the first is the total height along the full length of the fabric 20, which is conventionally referenced as the "width" of the fabric 20 during manufacturing of the fabric, but is referenced as fabric height herein because of its vertical orientation in use on the stakes 28 in the fence 10.

The nonwoven silt retention fabric 20 according to the present invention has a total height of 20"-48", preferably 24"-40" and most preferably 30"-36".

The second height of the fabric 20 of the fence 10 is the above ground height or vertical distance from the top of the fabric 20 to the ground, which effectively defines the effective height of the fence 10. The silt fence 10 of the present invention has an above ground height of 18"-36", generally around 24".

Fabric 20 Material Thickness

The nonwoven silt retention fabric according to the present invention has a material thickness of at least 5.25 mm generally about 5.25 mm to about 15.5 mm. In a representative example of the present invention the fabric 20 has a material thickness of 218 mils (ASTM 5199) or 5.53 mm.

Nonwoven Denier of Fabric 20

Denier is a unit of measurement that is used to determine the fiber thickness of individual threads or filaments used in the creation of textiles and fabrics. Fabrics with a generally high denier count tend to be thick, sturdy, and durable. Fabrics with a generally low denier count tend to be sheer, soft, and silty. Denier technically is a measure of weight in grams of nine kilometers of length of the material. The lower the denier number is then the finer the material is and the higher the denier number is then the coarser the material is. The Denier measurements compares with the TEX measurement wherein one denier equals $1/9^{th}$ of a TEX.

The nonwoven silt retention fabric 20 according to the present invention has a denier number of the fibers 50 dependent upon the material. For example the preferred denier of polyester fibers 50 is equal to or greater than 15 denier, generally 15-50 denier and preferably 20-25 denier, whereas the preferred denier number for PP fibers 50 is greater than or equal to 10 denier, generally 10-40 denier, and more preferably 15-20 denier. The preferred denier numbers of other fiber materials will vary according to these general parameters and the relative densities of the associated materials.

In the representative example of the present invention the fibers 50 forming the fabric 20 are 91 g/cm3 15 denier, 4-inch "crimped" long strand Polypropylene fibers 50.

Weight

The nonwoven silt retention fabric 20 according to the present invention has a weight that is preferably 9-24 oz/square yard, and more preferably 10-20 oz/square yard and most preferably 15-19 oz/square yard. In a representative example of the present invention the fabric 20 is 18.25 oz/square yard (ASTM 5199).

Fiber Length

The nonwoven silt retention fabric 20 according to the present invention is preferably formed of long strand fibers, namely about 3-6" long preferably about 4" long fibers, with the fibers being crimped.

Permittivity

The nonwoven silt retention fabric 20 according to the present invention has a permittivity of 55-200 gallons/minute/sq. ft. (gpm/ft2) as measured by ASTM 4491 (type C), generally 60-90 gpm/ft2. In a representative example of the present invention the fabric 20 exhibited a permittivity of 87 gpm/ft2.

Grab Strength

The nonwoven silt retention fabric 20 of the fence 10 according to the present invention exhibits a grab strength (ASTM 4632) of about 250-600 LBS, with the representative example having 317 LBS in the machine direction 22 and 542 LBS in the transverse direction 24.

Grab Elongation

The nonwoven silt retention fabric 20 of the fence 10 according to the present invention exhibits a grab elongation (ASTM 4632) of about 100-200%, with the representative example having 192% in the machine direction 22 and 120% in the transverse direction 24.

Trapezoid Tear Strength

The nonwoven silt retention fabric 20 of the fence 10 according to the present invention exhibits a trapezoid tear strength (ASTM 4533) of about 120-350 LBS, with the representative example having 305 LBS in the machine direction 22 and 141 LBS in the transverse direction 24.

Mullen Ball Burst

The nonwoven silt retention fabric 20 of the fence 10 according to the present invention yields a tensile strength or mullen burst strength (ASTM 3786) of about 450-800 LBS with the representative example having 480 LBS.

Sediment Removal Rate

ASTM D5141-11(2018) sets forth a standard test method for determining filtering efficiency and flow rate of the filtration component of a sediment retention device. The nonwoven silt retention fabric 20 of the fence 10 according to the present invention yields a retention rate of 92% or greater average after 5 iterations with the representative example having a retention rate of 98.6% after 5 iterations Puncture Strength The nonwoven silt retention fabric 20 of the fence 10 according to the present invention exhibits puncture strength (ASTM 4833) of at least 150 LBS.

AOS

The nonwoven silt retention fabric 20 of the fence 10 according to one embodiment of the present invention exhibits an AOS (ASTM 4751) of 100.

Vertical Orientation

Figure 1B:
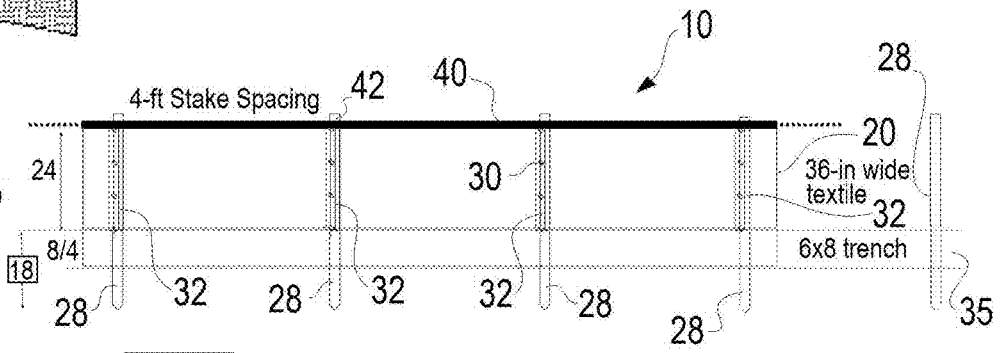
FIG. 1B schematically illustrates a front elevation view of the heavy duty silt fence of FIG. 1.
Figure 2A:
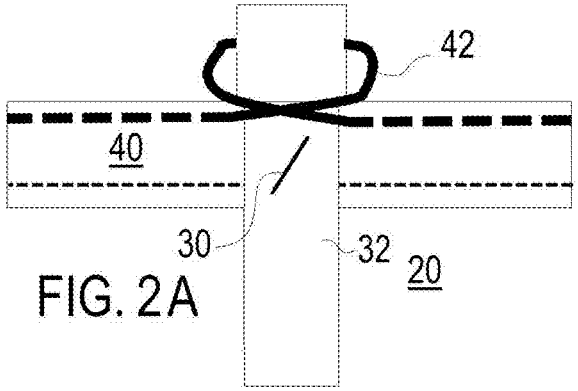
FIG. 2A schematically illustrate an enlarged front elevation view of the independent top tensioning members of the heavy duty silt fence of FIG. 1.
Figure 2B:
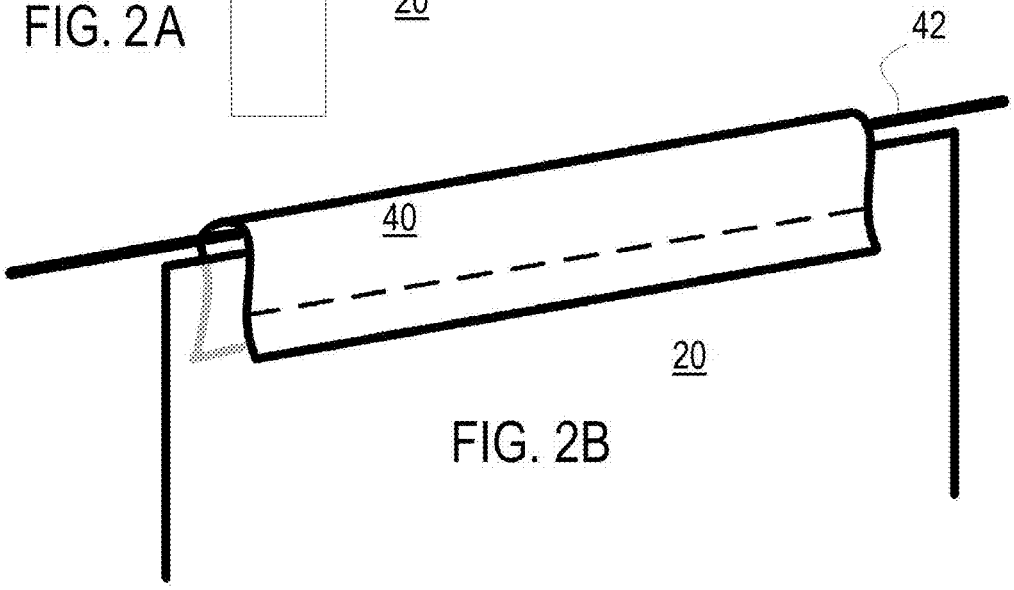
FIG. 2B schematically illustrate an enlarged perspective view of the independent top tensioning members of the heavy duty silt fence of FIG. 1.
Figure 1C:
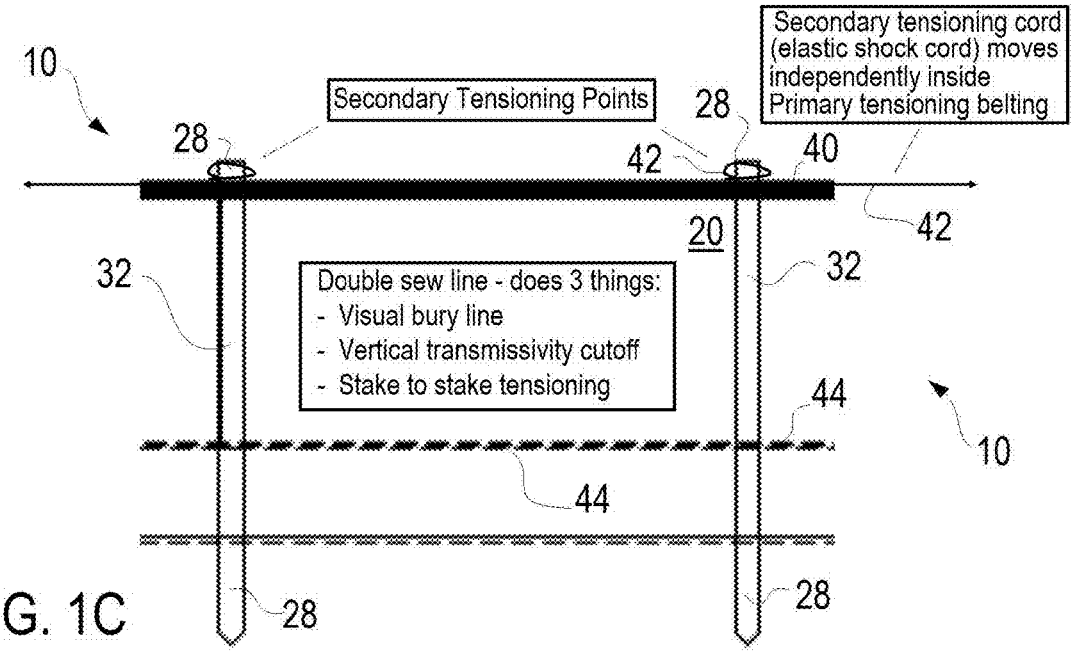
FIGS. 1C-E schematically illustrate a front elevation view of one bounded reinforced segment of the heavy duty silt fence of FIG. 1.
Figure 1D:
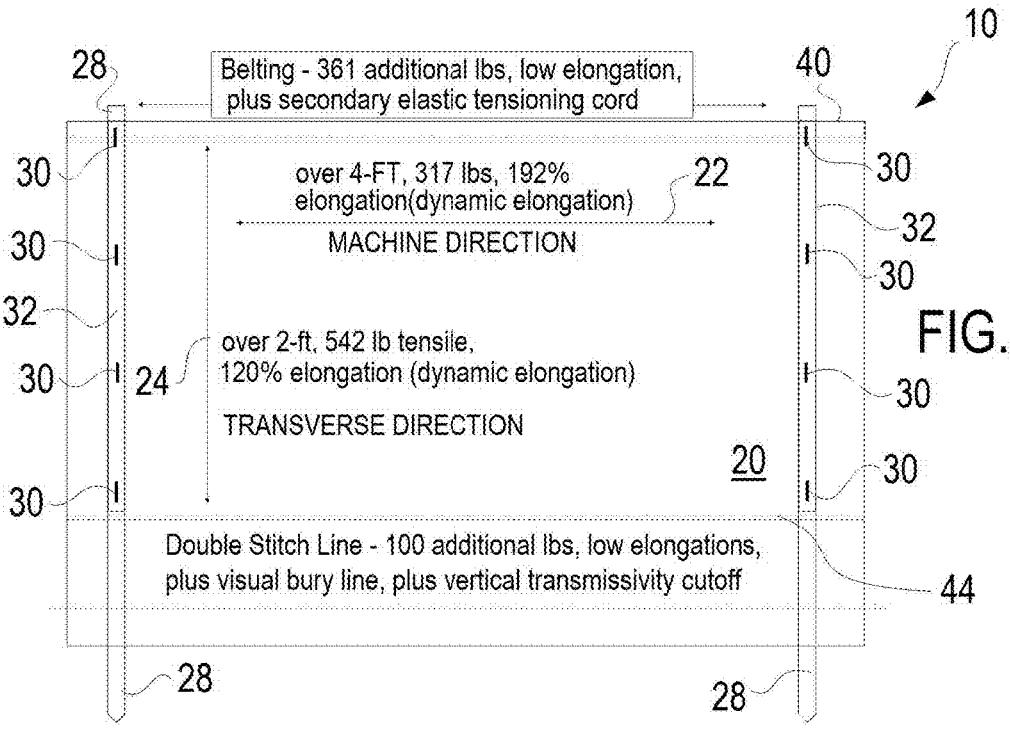
Figure 1E:
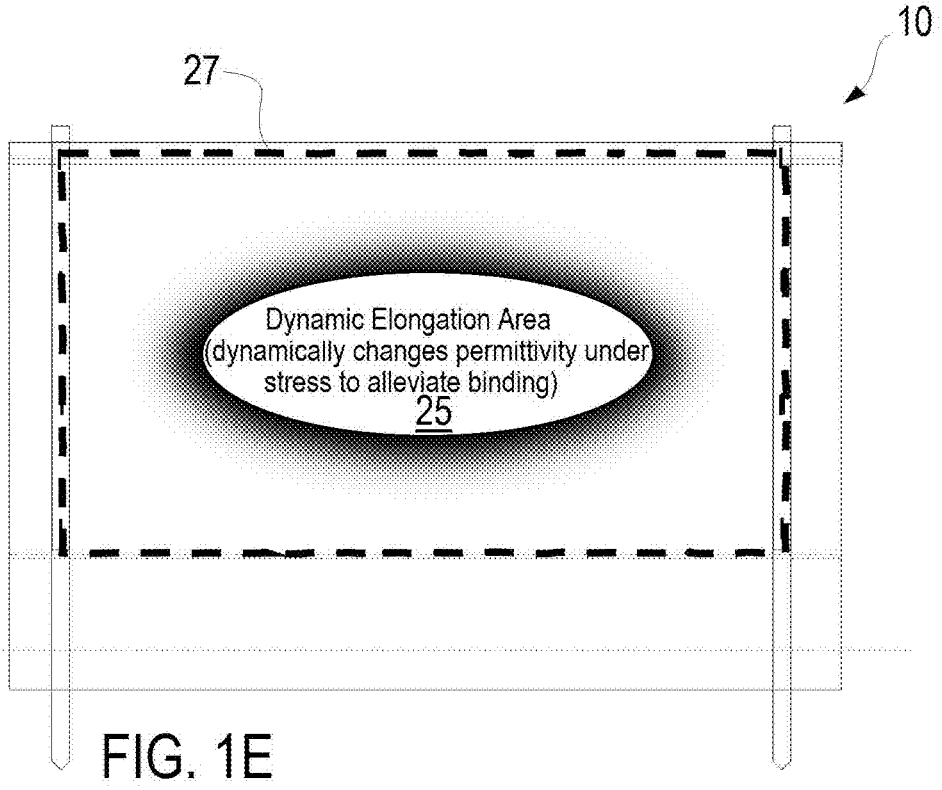
Figure 3:
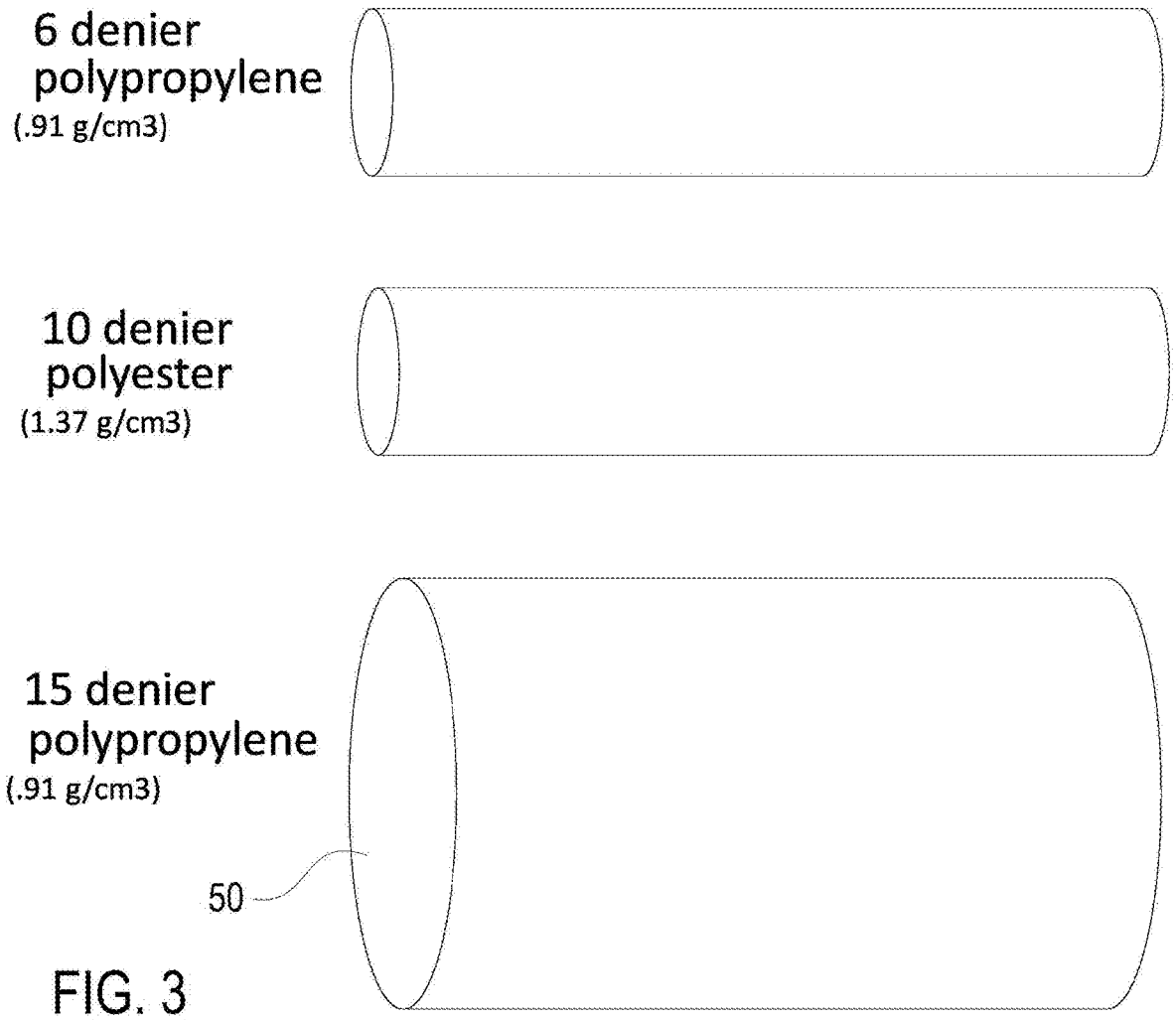
FIG. 3 schematically illustrates relative fiber deniers including those used in forming the heavy duty silt fence of FIG. 1.

FIG. 4A schematically illustrates one fiber orientating processing line that may be used in forming the heavy duty silt fence of FIG. 1. As shown the initial processing components 62 is orientated 90 degrees from the remaining processing units 64. This results in an orientation of the fibers 50 generally in the transverse direction 24 rather than in the machine direction as would occur with more conventional nonwoven processing lines. This fiber orientation is called a vertical orientation in this application as the fence 10 is typically vertical. The vertical alignment of fibers 50 is believed to improve the performance of the fence 10.

Asymmetric Dual Sided Needle Punching

A part of the processing units 64 includes a dual sided punching unit for punching the fibers 50 forming the fabric 20. Dual sided needle punching is typically performed symmetrically on both sides yielding a configuration as shown in FIG. 5A. The present invention uses asymmetrical dual sided needle punching wherein the downstream side of the fabric 20 is punched 2×6 times more, preferably 3 times more than the upstream side. This asymmetrical dual sided needle punching results in a smoother side on the downstream side and a "fuzzy" side on the upstream side of the fabric, with upstream side being the side of the fabric 20 of the fence 10 facing the path of water 5. The asymmetrical dual side needle punching may be accomplished by using the same pattern of needles on both sides and operating the downstream side three times faster. Alternatively the downstream side may use a needle pattern with 3× denser needle pattern than the upstream needle pattern. A combination of speed of needle punching and needles patterning could also be used (i.e the upstream having a 1.5× denser patter that is operated at 2× speed to yield the 3× needle punching.

In operation the fuzzy side of the dual sided asymmetric punched fabric resists blinding more than the smooth side, and exhibits a 10% higher puncture and burst resistance.

The present invention has been described with reference to specific details of particular embodiments thereof. It is not intended that such details be regarded as limitations upon the scope of the invention except insofar as and to the extent that they are included in the accompanying claims. A number of variations to the present invention will be apparent to those of ordinary skill in the art and these variations will not depart from the spirit and scope of the present invention. The scope of the invention is defined by the appended claims and equivalents thereto.

We claim:

1. The silt fence comprising:

a plurality of spaced stakes; and a silt fence fabric coupled to the spaced stakes, wherein the silt fence fabric is a nonwoven needle punched fabric having a fabric thickness of at least 5.25 mm, and a weight of 9-24 oz/square yard, and wherein the silt fence fabric is formed of fibers having a denier size of 10-25, wherein the silt fence fabric is asymmetrical dual sided needle punched wherein the silt fence has a downstream side and an upstream side when installed and a side of the silt fence fabric facing the downstream side is punched more than a side of the silt fence fabric facing the upstream side.

2. The silt fence according to claim 1, wherein the side of the silt fence fabric facing the downstream side is punched 2 to 6 times more than the side of the silt fence fabric facing the upstream side.

3. The silt fence comprising:

a plurality of spaced stakes; and a silt fence fabric coupled to the spaced stakes, wherein the silt fence fabric is a nonwoven needle punched fabric, wherein the silt fence includes at least one vertical transverstivity cutoff element that prevents water from migrating through the silt fence fabric from vertically above the transverstivity cutoff element within the silt fence fabric to vertically below the transverstivity cutoff element, wherein the silt fence fabric is asymmetrical dual sided needle punched, wherein the silt fence has a downstream side and an upstream side when installed and a side of the silt fence fabric facing the downstream side is punched more than a side of the silt fence fabric facing the upstream side.

4. The silt fence according to claim 3, wherein the side of the silt fence fabric facing the downstream side is punched 2 to 6 times more than the side of the silt fence fabric facing the upstream side.

5. A silt fence comprising:

a plurality of spaced stakes; and a silt fence fabric coupled to the spaced stakes, wherein the silt fence fabric is a nonwoven needle punched fabric, wherein the silt fence fabric is asymmetrical dual sided needle punched, wherein the silt fence has a downstream side and an upstream side when installed and a side of the silt fence fabric facing the downstream side is punched 2-6 times more than a side of the silt fence fabric facing the upstream side.

* * * * *